US007718037B2

(12) United States Patent
Conn et al.

(10) Patent No.: US 7,718,037 B2
(45) Date of Patent: May 18, 2010

(54) CREPING FOIL FOR REDIRECTING DUST

(75) Inventors: Richard Harvey Conn, Channing, MI (US); Donald Wilson Adams, Jr., Union, KY (US); Mitchell Alan Malcolm, Leesburg, GA (US)

(73) Assignee: The Procter & Gamble Company, Cincinnati, OH (US)

( * ) Notice: Subject to any disclaimer, the term of this patent is extended or adjusted under 35 U.S.C. 154(b) by 546 days.

(21) Appl. No.: 11/789,825

(22) Filed: Apr. 26, 2007

(65) Prior Publication Data

US 2008/0264592 A1 Oct. 30, 2008

(51) Int. Cl.
*B31F 1/12* (2006.01)

(52) U.S. Cl. ..... 162/280; 162/281; 162/289; 15/256.51; 118/413

(58) Field of Classification Search ..... 162/280, 162/281, 289; 15/256.51; 118/413
See application file for complete search history.

(56) References Cited

U.S. PATENT DOCUMENTS

| | | | | |
|---|---|---|---|---|
| 4,906,333 | A * | 3/1990 | Myren | 162/111 |
| 5,635,031 | A | 6/1997 | Enkvist | |
| 5,800,679 | A | 9/1998 | Lindstrom et al. | |
| 5,891,309 | A | 4/1999 | Page et al. | |
| 6,375,801 | B2 | 4/2002 | McGary et al. | |
| 2005/0161185 | A1 | 7/2005 | Weigant et al. | |

* cited by examiner

*Primary Examiner*—Mark Halpern
(74) *Attorney, Agent, or Firm*—Peter D. Meyer

(57) ABSTRACT

A creping foil having a machine direction, cross machine direction, and Z-direction normal to a plane formed by machine direction and cross machine directions. The creping foil also has a front face, back face, and bottom side. The front face has one or more top conduits with one or more upper pipes integrally mounted therein. The one or more upper pipes are rotatable about an axis in the cross machine direction and have one or more upper diameter holes. The bottom side has one or more bottom conduits with one or more lower pipes integrally mounted therein. The one or more lower pipes are rotatable about an axis in the cross machine direction and have one or more lower diameter holes.

21 Claims, 7 Drawing Sheets

CREPING FOIL FOR REDIRECTING DUST

FIELD OF THE INVENTION

The present invention relates generally to the reduction of dust in papermaking processes through the disruption of the flow of dust laden air in the boundary layer near the surface of a paper web. More specifically, the present invention relates to a creping foil having pipes for the propulsion of fluid integrally mounted thereon.

BACKGROUND OF THE INVENTION

Dust can be generated when a paper web is separated from a Yankee dryer by a creping blade. Much of the dust is carried along the web in a boundary layer of air which forms due to the rapid movement of the web away from the Yankee dryer. The dust in the boundary layer oftentimes spreads into the areas around the paper machine or other equipment and may cause unwanted contamination of those parts of the paper machine.

A number of problems may be related to the production, and presence, of dust in a paper machine. For example, during printing operations unwanted dust can reduce the aesthetic quality of the final product by mixing with, or getting caught in, printing ink. Relatively high amounts of dust may also be a source of physical irritation for any person who may be in close enough proximity to inhale it. Further, dust may present a fire hazard, can be the cause of increased maintenance costs, premature equipment wear and sheet breaks.

Without being limited by theory, it is thought that dust can be formed from paper fibers which can be liberated from the paper web as a paper web impacts the surface of a creping blade. Upon liberation from the paper web, the dust may be drawn into the fluid (air) boundary layer traveling along the surface of the moving paper web. Without wishing to be limited by theory, it is thought that that approximately 90% of dust that is formed at the creping blade is drawn into the above-mentioned boundary layer.

The prior art methods of removing dust that results from the creping of paper off a Yankee dryer include the use of large vacuums or high horsepower fan-driven dust extraction systems that collect and/or separate dust from the surrounding air. However, without being limited by theory, it is thought that the forces exerted onto a paper web by fans or vacuums may cause loss of sheet control or tearing of the paper web.

Thus, there exists the need for an efficient device and method to control the migration of dust in a papermaking process that provides a minimal level of disruption to the papermaking process and in particular, to the paper web.

SUMMARY OF THE INVENTION

In one embodiment the present invention relates to a creping foil comprising: a machine direction, cross machine direction, and Z-direction normal to a plane formed by machine direction and cross machine directions. The creping foil further comprises a front face, back face, and bottom side. The front face comprises one or more top conduits having one or more upper pipes integrally mounted therein; the one or more upper pipes are rotatable about an axis in the cross machine direction and have one or more upper diameter holes. The bottom side comprises one or more bottom conduits having one or more lower pipes integrally mounted therein. The one or more lower pipes are rotatable about an axis in the cross machine direction and have one or more lower diameter holes.

In another embodiment the present invention relates to a creping foil comprising: a machine direction, cross machine direction, and Z-direction normal to a plane formed by machine direction and cross machine directions. The creping foil further comprises a front face, back face, bottom side, and two or more side faces. The front face comprises one or more top conduits having one or more upper pipes integrally mounted therein; the one or more upper pipes are rotatable about an axis in the cross machine direction and have one or more upper diameter holes. The bottom side comprises one or more bottom conduits having one or more lower pipes integrally mounted therein. The one or more lower pipes are rotatable about an axis in the cross machine direction and have one or more lower diameter holes. One or more of the side faces comprises one or more creping foil pivots.

BRIEF DESCRIPTION OF THE DRAWINGS

While the specification concludes with claims that particularly point out and distinctly claim the present invention, it is believed that the present invention will be understood better from the following description of embodiments, taken in conjunction with the accompanying drawings, in which like reference numerals identify identical elements.

Without intending to limit the invention, embodiments are described in more detail below.

DETAILED DESCRIPTION OF THE INVENTION

Definitions

Figure 1:
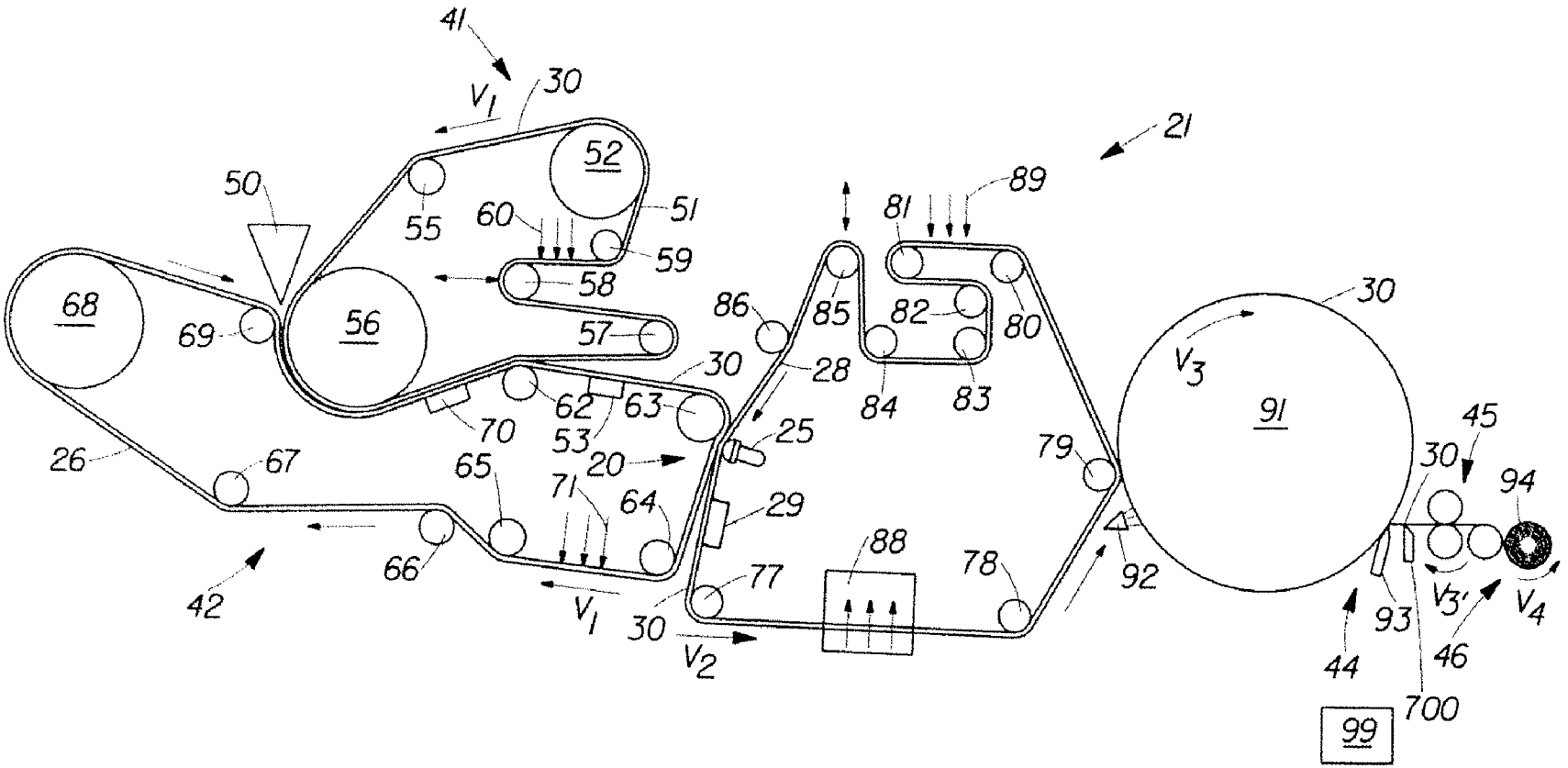
FIG. 1 is a schematic side view of an exemplary embodiment of a papermaking machine.

"Doctor blade" or "blade" as used herein refers to a blade that is disposed adjacent to a piece of equipment so that the doctor blade can remove a material that may be disposed on the piece of equipment. Doctor blades are commonly used in many different industries for many different purposes. Examples of materials include, but are not limited to: tissue webs, paper webs, glue, residual buildup, pitch, and combinations thereof. Examples of equipment include, but are not limited to: drums, plates, Yankee dryers, rollers, and combinations thereof. Exemplary industries that use doctor blades include, but are not limited to: papermaking, nonwoven manufacture, tobacco, and printing, coating and adhesives processes.

"Creping blade" or "creper blade" as used herein, refers to a doctor blade used in the papermaking industry to remove a paper web from a drum and to provide some "crepe" or fold to the web. Creping blades can have the dual function of removing a web from a piece of equipment, such as, for example a Yankee dryer, and providing the web with crepe.

"Creping foil" or "Creping blade foil" or "creper blade foil" or "creper foil" or "foil" as used herein, refers to a web-support structure that may be positioned anywhere in the dry end of a papermaking machine in which mechanical action is performed on a paper web. In one embodiment, the creping foil may be positioned in relatively close proximity to a creping blade in a papermaking machine. In one embodiment, the creping foil can serve as a means to improve sheet control as a paper web leaves the Yankee dryer after it contacts with the creping blade. In another embodiment, the creping foil disrupts the dust-containing boundary layer that forms around the paper web as it leaves the creping blade. In one embodiment, the creping foil is positioned under the paper web during operation. In another embodiment, the creping foil is positioned above the paper web during operation.

"Fluid" as used herein, refers to any matter having particles that may continually deform or flow under an applied shear stress regardless of the magnitude of the applied stress.

"Yankee dryer" or "Yankee roll" or "Yankee" as used herein, refers to a drum for drying paper webs that may not be strong enough to endure numerous felt transfers. The Yankee dryer dries paper as it comes off the wet end of the papermaking machine by pressing one side of the paper web against a cylinder that is typically heated with steam. In some embodiments, the web is glued to the Yankee to keep the web under control. In some embodiments the Yankee dryer may be a cylindrical metal drum having a diameter of from about 3.5 to about 5.5 meters. While on the Yankee dryer, the paper web goes from about 30% dryness to about 95% dryness.

As used herein, "Machine Direction" or "MD" means the direction parallel to the flow of the fibrous structure or paper web through a papermaking machine and/or product manufacturing equipment.

As used herein, "Cross Machine Direction" or "CD" means the direction perpendicular to, and coplanar with, the machine direction of the paper web and/or fibrous structure product comprising the fibrous structure.

As used herein, "Z-direction" means the direction normal to a plane formed by machine direction and cross machine directions.

"Sheet control" as used herein, refers to the lack of vibrations, turbulence, edge flipping, flutter, or weaving of the web that result in a loss of control at higher speeds.

Paper Web

Paper making fibers useful in the present invention include cellulosic fibers commonly known as wood pulp fibers. Applicable wood pulps include chemical pulps, such as Kraft, sulfite and sulfate pulps; mechanical pulps including groundwood, thermo-mechanical pulp; chemical-thermo-mechanical pulp; chemically modified pulps, and the like. Chemical pulps, however, may be preferred in tissue towel embodiments since they are known to those of skill in the art to impart a superior tactile experience and softness to tissue sheets made therefrom. Pulps derived from deciduous trees (hardwood) and/or coniferous trees (softwood) can be utilized herein.

Such hardwood and softwood fibers can be blended or deposited in layers to provide a stratified paper web. Exemplary layering embodiments and processes of layering are disclosed in U.S. Pat. Nos. 3,994,771 and 4,300,981. Additionally, fibers derived from non-wood pulp such as cotton linters, bagesse, and the like, can be used. Additionally, fibers derived from recycled paper, which may contain any or all of the pulp categories listed above, as well as other non-fibrous materials such as fillers and adhesives used to manufacture the original paper product may be used in the present web. In addition, fibers and/or filaments made from polymers, specifically hydroxyl polymers, may be used in the present invention. Non-limiting examples of suitable hydroxyl polymers include polyvinyl alcohol, starch, starch derivatives, chitosan, chitosan derivatives, cellulose derivatives, gums, arabinans, galactans, and combinations thereof. Additionally, other synthetic fibers such as rayon, lyocel, polyester, polyethylene, and polypropylene fibers can be used within the scope of the present invention. Further, such fibers may be latex bonded. Other materials are also intended to be within the scope of the present invention as long as they do not interfere or counter act any advantage presented by the instant invention.

Synthetic fibers useful herein include any material, such as, but not limited to, those selected from the group consisting of polyesters, polypropylenes, polyethylenes, polyethers, polyamides, polyhydroxyalkanoates, polysaccharides, and combinations thereof. The synthetic fiber may comprise a polymer. The polymer may be any material, such as, but not limited to, those materials selected from the group consisting of polyesters, polyamides, polyhydroxyalkanoates, polysaccharides and combinations thereof. More specifically, the material of the polymer segment may be selected from the group consisting of poly(ethylene terephthalate), poly(butylene terephthalate), poly(1,4-cyclohexylenedimethylene terephthalate), isophthalic acid copolymers (e.g., terephthalate cyclohexylene-dimethylene isophthalate copolymer), ethylene glycol copolymers (e.g., ethylene terephthalate cyclohexylene-dimethylene copolymer), polycaprolactone, poly(hydroxyl ether ester), poly(hydroxyl ether amide), polyesteramide, poly(lactic acid), polyhydroxybutyrate, and combinations thereof.

Further, the synthetic fibers can be a single component (i.e., single synthetic material or mixture makes up entire fiber), bi-component (i.e., the fiber is divided into regions, the regions including two or more different synthetic materials or mixtures thereof and may include co-extruded fibers) and combinations thereof. It is also possible to use bicomponent fibers, or simply bicomponent or sheath polymers. Nonlimiting examples suitable bicomponent fibers are fibers made of copolymers of polyester (polyethylene terephthalate)/polyester (polyethylene terephthalate) (otherwise known as "CoPET/PET" fibers), which are commercially available from Fiber Innovation Technology, Inc., Johnson City, Tenn. These bicomponent fibers can be used as a component fiber of the structure, and/or they may be present to act as a binder for the other fibers present. Any or all of the synthetic fibers may be treated before, during, or after the process of the present invention to change any desired properties of the fibers. For example, in certain embodiments, it may be desirable to treat the synthetic fibers before or during the papermaking process to make them more hydrophilic, more wettable, etc.

The paper web may comprise a tissue-towel paper product known in the industry. Embodiment of these substrates may be made according U.S. Pat. Nos.: 4,191,609, 4,300,981, 4,191,609, 4,514,345, 4,528,239, 4,529,480, 4,637,859, 5,245,025, 5,275,700, 5,328,565, 5,334,289, 5,364,504, 5,527,428, 5,556,509, 5,628,876, 5,629,052, 5,637,194, and 5,411,636; EP 677612; and U.S. Patent App. No. 2004/0192136A1.

The paper web may be manufactured via a wet-laid making process where the resultant paper web may be comprised of fibrous structure selected from the group consisting of: through-air-dried fibrous structure plies, differential density fibrous structure plies, wet laid fibrous structure plies, air laid fibrous structure plies, conventional fibrous structure plies, and combinations thereof.

Optionally, the paper web may be foreshortened by creping or by wet microcontraction. Creping and/or wet microcontraction are disclosed in U.S. Pat. Nos.: 6,048,938, 5,942,085, 5,865,950, 4,440,597, 4,191,756, and 6,187,138.

The substrate which comprises the paper web may be cellulosic, non-cellulosic, or a combination of both. The substrate may be conventionally dried using one or more press felts or through-air dried. If the substrate which comprises the paper web is conventionally dried, it may be conventionally dried using a felt which applies a pattern to the paper as taught by commonly assigned U.S. Pat. No. 5,556,509 and PCT Application WO 96/00812. The substrate which comprises the paper web may also be through air dried. A suitable through air dried substrate may be made according to commonly assigned U.S. Pat. No. 4,191,609.

In one embodiment, the substrate which comprises the paper web may be through air dried on a belt having a patterned framework. The belt according to the present invention may be made according to any of commonly assigned U.S. Pat. Nos. 4,637,859, 4,514,345, 5,328,565, and 5,334,289.

Papermaking Machine

FIG. 1 shows a schematic view of an exemplary papermaking machine 21 in which the present invention may be used. The papermaking machine 21 comprises transfer zone 20 as described herein and, additionally: a forming section 41, an intermediate carrier section 42, a pre-dryer/imprinting section 43, a drying/creping section 44, a calendar assembly 45, and reel 46.

The forming section 41 of the papermaking machine 21 comprises a headbox 50; a loop of fine mesh backing wire or fabric 51 which is looped about a vacuum breast roll 52, over vacuum box 70, about rolls 55 through 59, and under showers 60. Intermediate rolls 56 and 57, backing wire/fabric 51 is deflected from a straight run by a separation roll 62. Biasing means not shown are provided for moving roll 58 as indicated by the adjacent arrow to maintain fabric/wire 51 in a slack obviating tensioned state.

The intermediate carrier section 42 comprises a loop of forming and carrier fabric 26 which is looped about rolls 62 through 69 and about a portion of roll 56. The forming and carrier fabric 26 also passes over vacuum boxes 70 and 53, and transfer head 25; and under showers 71. Biasing means are also provided to move roll 65 to obviate slack in fabric 26. Juxtaposed portions of fabrics 51 and 26 extend about an arcuate portion of roll 56, across vacuum box 70, and separate after passing over an arcuate portion of separation roll 62. In one embodiment, forming and carrier fabric 26 is identical to backing wire/fabric 51 except for the lengths.

The pre-dryer/imprinting section 43 of papermaking machine 21 comprises a loop of transfer fabric or imprinting fabric 28. Transfer/imprinting fabric 28 is looped about rolls 77 through 86; passes across transfer head 25 and vacuum box 29; through a blow-through pre-dryer 88; and under showers 89. Additionally, not shown is a biasing mechanism for biasing roll 79 towards the adjacent Yankee dryer 91 with a predetermined force per lineal inch to effect imprinting the knuckle pattern of fabric 28 in paper web 30 in the manner of, and for the purpose disclosed in, U.S. Pat. No. 3,301,746. Not shown is a biasing mechanism for moving roll 85 as indicated by the adjacent arrow to obviate slack in fabric 28.

The drying/creping section 44 of papermaking machine 21 comprises Yankee dryer 91, adhesive applicator 92, creping blade 93, creper foil 700, reel roll 94, and dust collection device 99.

$V_1$ is the velocity of the papermaking fabrics 51 and 26. $V_2$ is the velocity about the transfer/printing rolls 77 through 86. $V_3$ is the velocity of the calendar assembly 45. $V_4$ is the reel velocity of the reel roll 94.

Creping Foil in a Papermaking Machine

The use of a foil or other web support devices positioned adjacent to a Yankee dryer above a creping blade is known in the art. An example of a foil being used to stabilize the paper web as it leaves the creping blade is described in U.S. Pat. No. 5,891,309. It should be noted that the use of a creping foil as described herein is not limited to use with a Yankee dryer, but the creping foil can be used anywhere in the dry end of the papermaking process, particularly in any area where there is some mechanical trauma exerted onto the paper web.

Figure 2A:
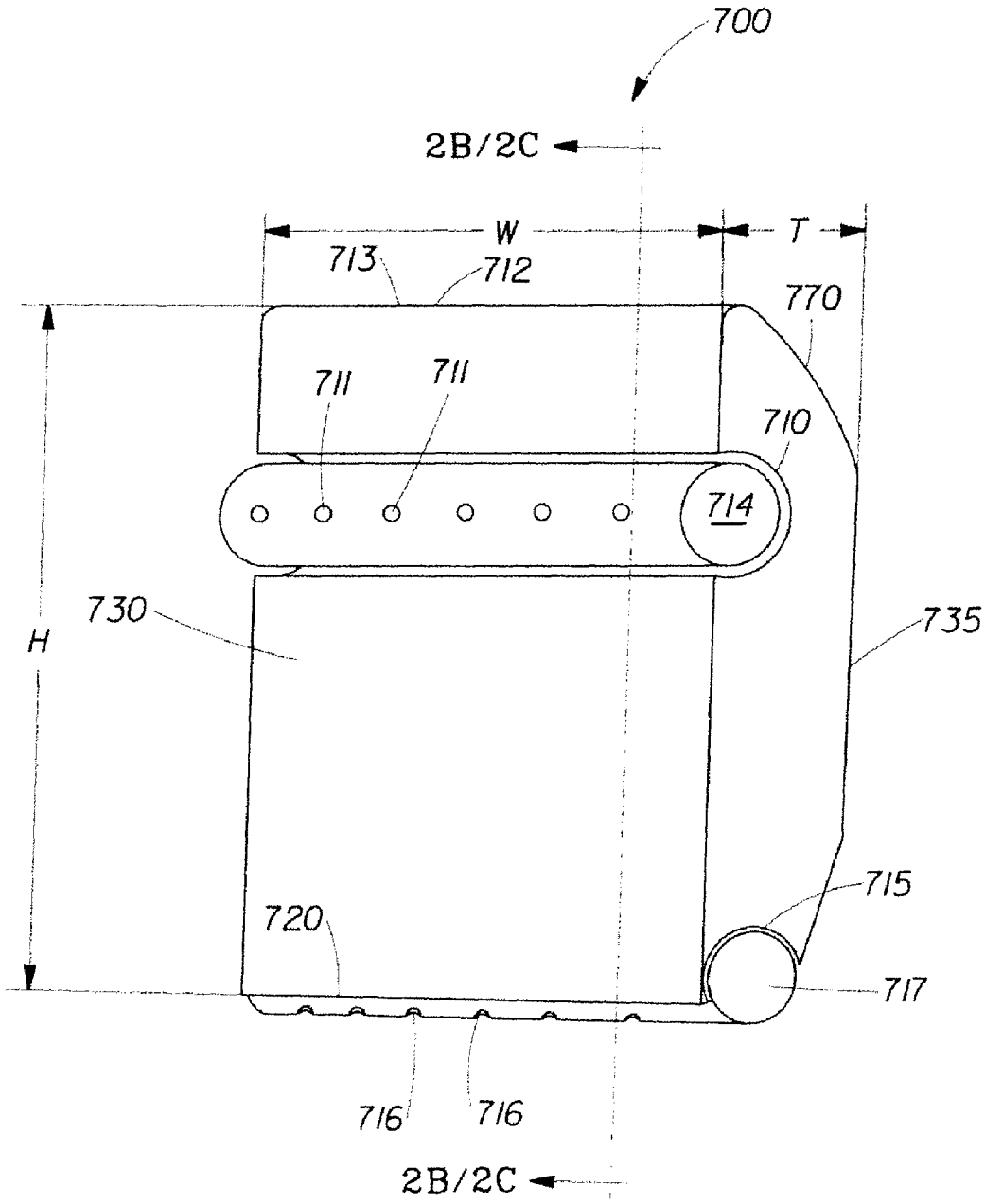
FIG. 2A is a perspective view of an exemplary embodiment of the present invention creping foil.

FIG. 2A is a nonlimiting embodiment of a creping foil 700 of the present invention. The creping foil 700 comprises a front face 730 and a back face 735. The front face 730 and back face 735 are spaced a distance T apart (thickness) and, in one embodiment, can be separated by two or more side faces 740. In one embodiment T is from about 1 inch (about 2.54 cm) to about 10 (about 25.4 cm) inches. In another embodiment T is from about 2 inches (about 5.08 cm) to about 3 inches (about 7.62 cm). In one embodiment, the creping foil 700 has a height H of from about 8" (about 20.32 cm) to about 20" (about 50.8 cm). In another embodiment H is from about 10" (about 25.4 cm) to about 16" (about 40.64 cm). In one embodiment, the creping foil 700 has a width W of from about 100" (about 254 cm) to about 360" (about 914.4 cm). In another embodiment W is from about 140" (about 355.6 cm) to about 300" (about 762 cm).

The creping foil 700 further comprises a top edge 713, top side 770, and bottom side 720. In one embodiment, the creping foil 700 further comprises an apex 712, wherein the apex 712 is defined the surface of creping foil 700 that connects the highest points (in the Z-direction) of the opposing side faces 714 of the creper foil. In some embodiments, the apex 712 is the same as the top edge 713. In one embodiment, the creping foil 700 further comprises one or more top conduits 710 that can be located on the front face 730 of the creping foil 700. In another embodiment, the creping foil 700 further comprises one or more bottom conduits 715 that can be located on the bottom side 720 of the creping foil 700. In one embodiment the creping foil 700 further comprises one or more upper pipes 714 that can be integrally mounted in a top conduit 710. In one embodiment, the upper pipe 714 comprises one or more openings, or upper diameter holes 711, for transport of a fluid through an upper pipe 714 into through an upper diameter hole 711. In one embodiment the creping foil 700 comprises one or more lower pipes 717 that can be integrally mounted in the interior of a lower conduit 715. In one embodiment, the lower pipe 717 comprises one or more openings, or lower diameter holes 716, for transport of a fluid through a lower pipe 717. In some embodiments, the upper pipe 714 and/or lower pipe 717 can be rotated about axes in the cross-machine direction such that the upper diameter holes 711 and lower diameter holes 716 can face at any angle. In one embodiment, there is only one upper diameter hole 711 and/or lower diameter hole 716 which can be a continuous line in the cross machine direction. In this embodiment the width of the hole is from about 0.005" (about 0.0127 cm) to about 0.5" (about 1.27 cm). In another embodiment, the upper diameter holes 711 and/or lower diameter holes 716 are circular and have a diameter of from about 0.005" (about 0.0127 cm) to about 0.5" (about 1.27 cm). In one embodiment, the upper diameter holes 711 and/or lower diameter holes 716 can be spaced a distance of from about ⅛" to about 4" apart. The upper diameter holes 711 and/or lower diameter holes 716 can be any shape and can have any spacing. Nonlimiting examples of fluid that can be used as a momentum barrier can be selected from the group consisting of: air, water, nitrogen gas, inert gases, and combinations thereof.

Figure 2B:
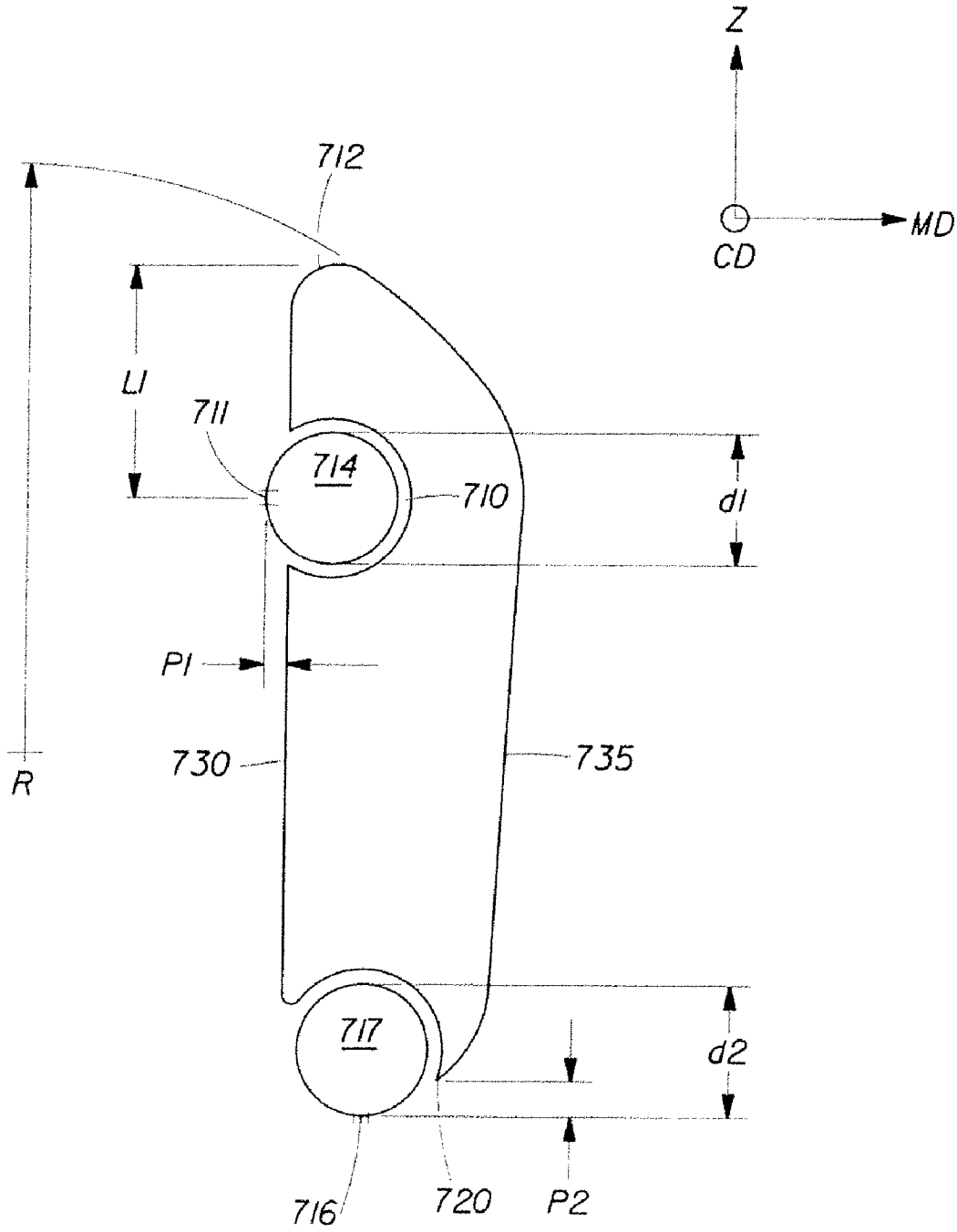
FIG. 2B is a cross-sectional view of an exemplary embodiment of the present invention creping foil of FIG. 2A taken along line 2B-2B.

FIG. 2B is a cross-sectional view of the creping foil 700 of FIG. 2A taken along line 2B-2B. In one embodiment the creping foil 700 has a radius of curvature R at the upper portion of the foil 700 near the apex 712. In an embodiment the center of the top conduit 710 is an upper vertical distance L1 from the apex 712 of the creping foil 700 to the center point of the top conduit 710 is from about 1" (about 2.54 cm) to about 5" (about 12.7 cm). In another embodiment, L1 is from about 2" (about 5.08 cm) to about 4" (about 10.16 cm). In one embodiment, the side face 714 of a creping foil 700 has a radius of curvature R of from about 200 inches (about 508 cm) to about infinity (a straight line). In another embodiment R is from about 275 inches (about 698.5 cm) to about 350 inches (about 889 cm). The one or more upper pipes 714 may be integrally mounted in the upper conduit 710 such that an upper pipe 714 may protrude a distance P1 out of the plane of the front face 730 in the machine direction. In one embodiment P1 is from about 1/16" (about 0.15875 cm) to about ½" (about 1.27 cm). Similarly, the one or more lower pipes 717 may be integrally mounted in the lower conduit 715 may protrude a distance P2 out of the plane of the front face 730 in the machine direction. In one embodiment P1 is from about 1/32" (about 0.079375 cm) to about ¼" (about 0.635 cm).

The creping foil 700 of the present invention can be made from any material or materials suitable for the particular purpose of the creper foil, whether the material(s) is now known or later becomes known. For example, a creper foil may be made from a material selected from the group consisting of: stainless steel, carbon steel, alloy metals, aluminum, aluminum alloys, composite materials, plastic, fiberglass, epoxy based, multi-bonded materials, carbon fibers, woven and/or bonded materials, cured and/or baked materials, plastics, wood, and combinations thereof.

As shown in the exemplary embodiment of FIG. 2B, one or more upper pipes 714 and one or more lower pipes 717 can be integrally mounted inside one or more upper conduits 710 or one or more lower conduits 715 (respectively). Fluid may be passed through the upper pipes 714 and/or lower pipes 717 and released through upper diameter holes 711 and/or lower diameter holes 716 (respectively). The fluid serves to disrupt the boundary layer that can be formed along the surface of the paper web 30 (shown in FIGS. 3-4.) In one embodiment the upper pipe 714 and/or lower pipe 717 comprises a tube mounted in the cross direction inside the upper conduit 710. In an embodiment, an upper pipe 714 and/or lower pipe 717 has a diameter d1 and/or d2 (respectively) of from about ¼ inches (about 0.635 cm) to about 2 inches (about 5.08 cm). In another embodiment d1 and/or d2 is from about ½ inches (about 1.27 cm) to about 1 inch (about 2.54 cm).

Figure 2C:
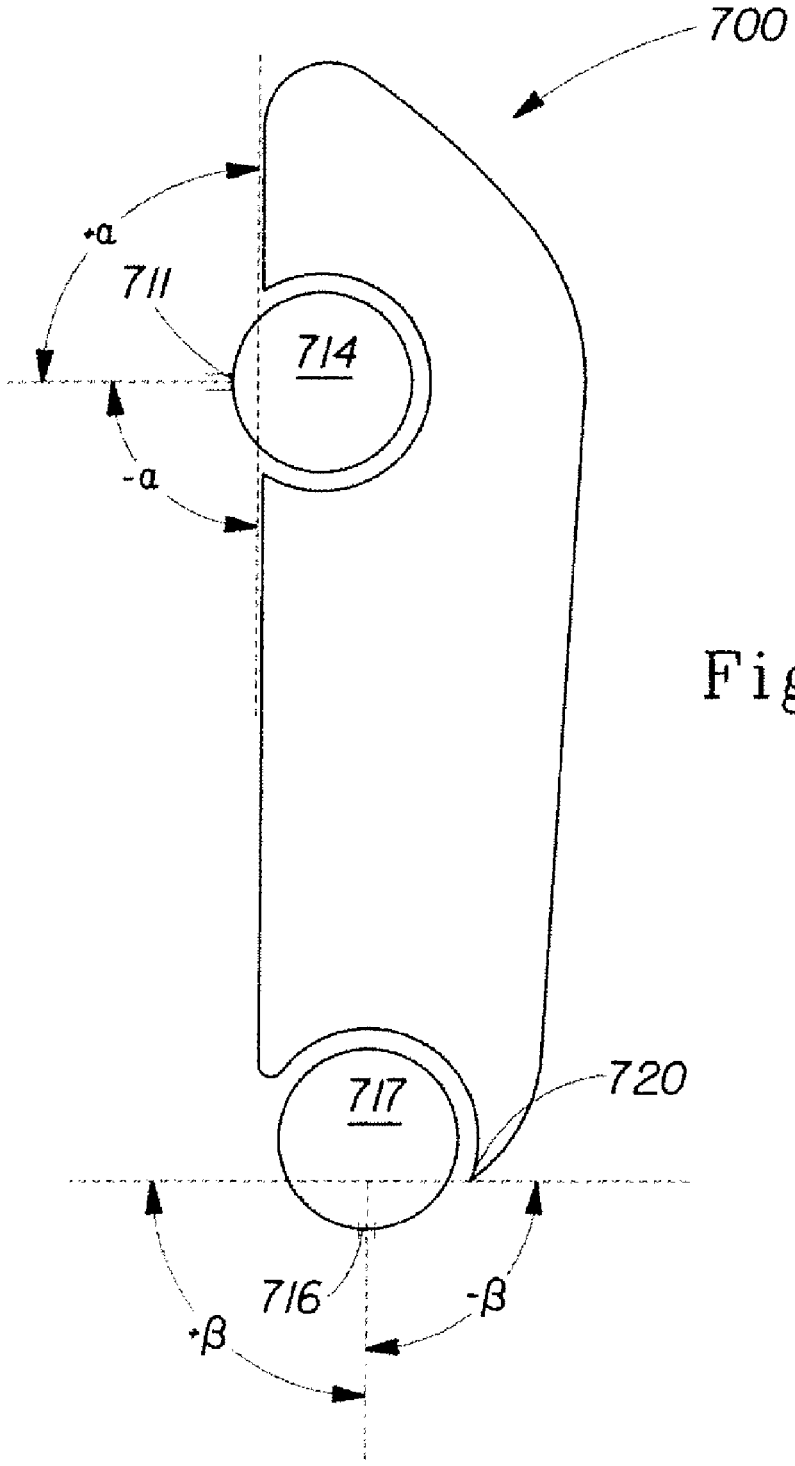
FIG. 2C is a cross-sectional view of an exemplary embodiment of the present invention creping foil of FIG. 2A taken along line 2C-2C.

FIG. 2C is a view of the cross-sectional view of the creping foil 700 of FIG. 2A taken along line 2C-2C. In one embodiment, the upper pipe 714 may be rotated about the cross machine direction such that the flow of fluid from the upper diameter holes 711 can be directed at an angle $\alpha$. The angle $\alpha$ is measured from the surface of the front face 730 of the creping foil 700. The line measuring $\alpha=0$ is a line that is perpendicular to the front face 730 of the creping foil 700. In an embodiment $\alpha$ is from about 80 degrees to about −80 degrees. In another embodiment $\alpha$ is from about from about 45 degrees to about −45 degrees. In an embodiment air is the fluid used in the upper pipe 714. In one embodiment, the lower pipe 717 may be rotated about the cross machine direction such that the flow of fluid from the lower diameter holes 716 can be directed at an angle $\beta$. The line measuring $\beta=0$ is a line that is perpendicular to the bottom side 720 of the creping foil 700. In an embodiment $\beta$ is from about 80 degrees to about −80 degrees. In another embodiment $\beta$ is from about from about 45 degrees to about −45 degrees. In some embodiments, air or water may be the fluid used in the lower pipe 717. In another embodiment a fan driven air supply provides the fluid used in the lower pipe 717. In one embodiment, the dust may be ultimately redirected to a any collection device or area such as, but not limited to: repulper, waste storage container, dust collection vessel, the like, and combinations thereof. In another embodiment the dust can be simply redirected to a floor or any other area/structure below the creping foil 700 where it may be collected periodically.

Creping Foil as Arranged in a Paper Machine

Figure 3:
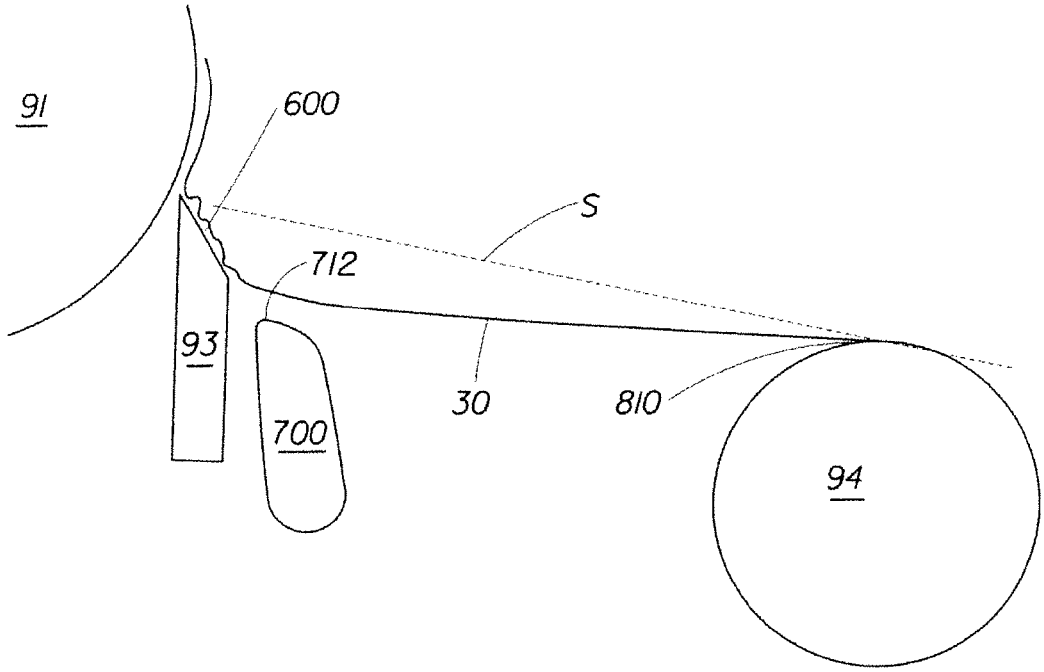
FIG. 3 is a schematic side view of an exemplary embodiment of the present invention creping foil as it may be used in the drying section of an exemplary papermaking machine.

FIG. 3 shows an expanded view of an exemplary embodiment of the creping section 44 of the papermaking machine 21 as shown in FIG. 1. In one embodiment the creping foil 700 is positioned such that it creates a tight barrier to a boundary layer of dust laden air that forms at the point of mechanical trauma 600 between the Yankee dryer 91 and the creping blade 93 on the paper web 30. S represents a straight line from the tip of the creping blade 93 to the intake point 810 of the reel roll 94. Because the diameter of the reel roll 94 (and therefore the intake point 810) increases as more of the paper web 30 is wound up, the direction of S changes with time. As used herein, S represents a "perfect" sheet path and a sheet traveling along S would be traveling at a height of 0 above or below the sheet path. In one embodiment the creping foil 700 is positioned such that the apex 712 of the creping foil 700 is a height of from about 0 to about ½" above S, thereby causing the paper web 30 to follow a path above S. In another embodiment, the creping foil 700 is positioned such that the apex 712 is a height of from about ⅛" to about ¼" above S. In one embodiment the creping foil 700 is positioned such that the apex 712 of the creping foil 700 is a distance of from about 2" to about 0" below S. In another embodiment, the creping foil 700 is positioned such that the apex 712 of the creping foil 700 is a height of from about 3/2" to about ¼" below S. In another embodiment, the creping foil 700 is positioned such that the apex 712 of the creping foil 700 is a height of from about 1" to about ½" below S. The creping foil 700 may be raised and/or lowered and/or pivoted by any means known in the art to achieve the change in distance above or below S as described above. The distance above or below S is measured normal to S.

In one embodiment, the creping foil 700 can be mounted from about 2 inches (about 5.08 cm) to about 10 inches (about 25.4 cm) in the machine direction away from the creping blade 93. In another embodiment, the creping foil 700 can be mounted from about 3 inches (about 7.62 cm) to about 8 inches (about 20.32 cm) in the machine direction away from the creping blade 93 to disrupt the flow of the boundary layer of air that forms around the web 30 after reaching the point of mechanical trauma 600 on the paper web 30. Without being limited by theory, it is thought that dust released from the point of mechanical trauma 600 on the paper web 30 is most dense when it is initially liberated at the creping blade 93 and is less dense as the distance from the creping blade 93 increases.

Figure 4:
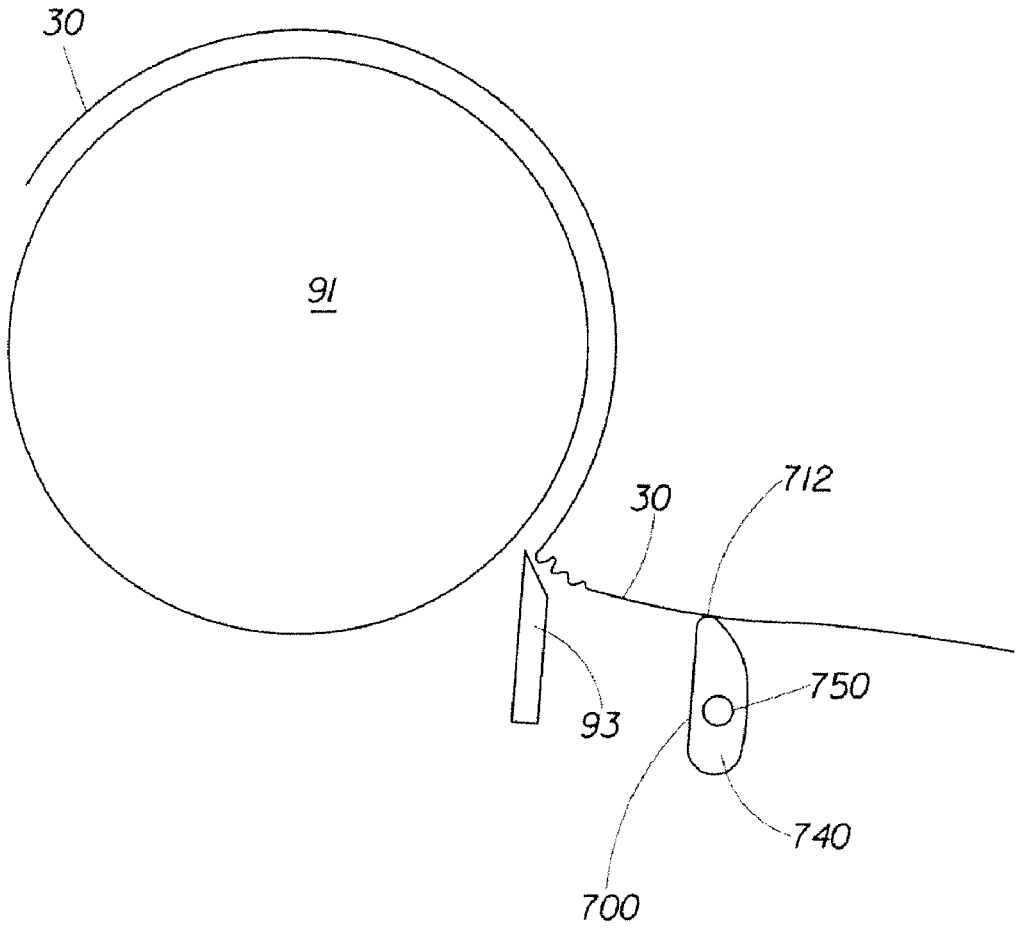
FIG. 4 is a schematic side view of an exemplary embodiment of the present invention creping foil as it may be used in the drying section of an exemplary papermaking machine.

FIG. 4 shows an exemplary embodiment of the creping section 44 as shown in FIG. 1. In one embodiment the creping foil 700 is located after the Yankee dryer 91 and creping blade 93 and below the paper web 30. In one embodiment, a paper web 30 is creped from the surface of the Yankee dryer 91 and passes over the creping foil 700. In the exemplary embodiment the creping foil 700 further comprises one or more creping foil pivots 750 such that the creping foil can be rotated about the creping foil pivot 750. In one embodiment the pivot 750 can be situated anywhere on the a side face 740 of the creping foil 700 such that the pivot can be used as an axis of rotation for the creping foil 700 so that the angle at which the creping foil 700 contacts the paper web 30 can be changed. Without wishing to be limited by theory, it is thought that the angle at which the creping foil 700 contacts the paper web 30 has an effect on the sheet control of the paper web 30 as it is thought that by rotating the creping foil 700 about the creping foil pivot 750, it is possible to select which surface of the creping foil 700 interacts with the paper web 30, thereby changing the level of sheet control and amount of dust that is reduced. In one embodiment, the creping foil 700 is rotated about the creping foil pivot 750 such that the apex 712 of the creping foil 700 is in front of the creping foil pivot 750 in the machine direction. In a different embodiment, the creping foil 700 is rotated about the creping foil pivot 750 such that the apex 712 is behind the creping foil pivot 750 in the machine direction.

Figure 5:
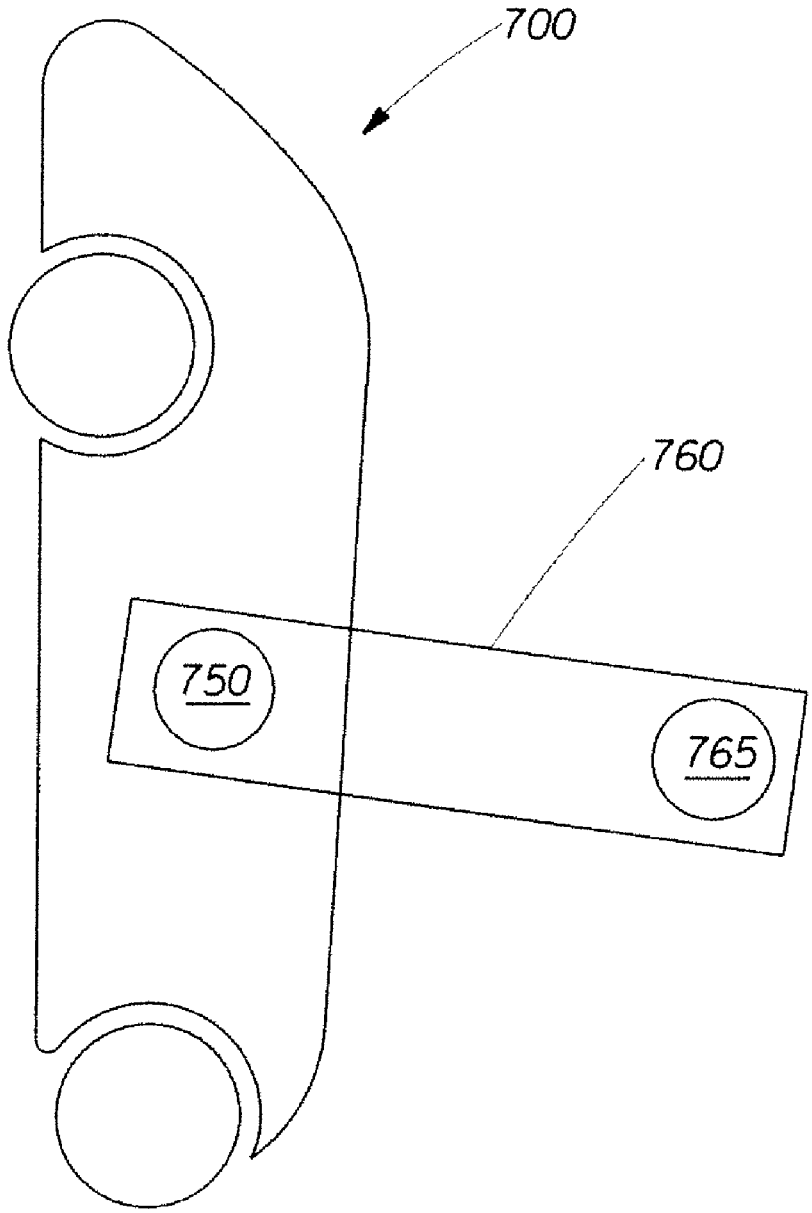
FIG. 5 is a schematic side view of an exemplary embodiment of the present invention creping foil.

FIG. 5 shows an exemplary embodiment of a creping foil 700 of the present invention wherein the creping foil 700 has a creping foil pivot 750 on each edge in the cross machine direction. In one embodiment one pivot 750 may be raised or lowered independently of the other creping foil pivot 750 such that the creping foil 700 is no longer parallel in the cross machine direction. Any means known in the art can be used to raise or lower the creping foil pivots 750. In one embodiment the creping foil 700 further comprises one or more arms 760, wherein each arm has a proximal end and a distal end. In one embodiment the creping foil pivots 750 are attached to the proximal end of the one or more arms 760 such that the creping foil 700. Each arm may further comprise one or more arm pivots 765 attached to the proximal end of each arm 760. The arm 760 is rotatable about the arm pivot 765 thus allowing the creping foil 700 to be raised or lowered.

Test Methods

Laboratory Conditions:

All conditioning and testing is performed under TAPPI standard conditions 50.0%±2.0% R.H. and 23.0±1.0° C. (T204 om-88). All samples are conditioned for a minimum of 2 hours before testing.

EXAMPLE

Papermaking Machine Having a Creping Foil

A papermaking machine of the general configuration shown in FIG. 1 and designated therein as papermaking machine 100 is run under the following conditions in accordance with the present invention to paper products, such as the Charmin™ product made by the Procter & Gamble Company (Cincinnati, Ohio). The furnish comprises sixty-five percent (65%) northern softwood kraft (NSK) (i.e., long papermaking fibers) and thirty-five percent (35%) chemithermal mechanical pulp. A strength additive, Kymene™ 557H, is added to the furnish at a rate of about 20 pounds per ton (about 10 gms/kg). Kymene is a registered trademark of Hercules Inc, of Wilmington, Del. Polyvinyl alcohol creping adhesive is used and an impact angle I of about 110 degrees is maintained. A fiber consistency of about 20% is maintained at the couch roll and a before-pre-dryer (hereinafter BPD) fiber consistency of about 25% is maintained. During the run, a constant velocity $V_1$ of about 680 feet per minute (about 207.264 meters per minute) is maintained for the papermaking fabrics 51 and 26; a constant reel velocity $V_4$ of about 575 feet per minute (about 175.26 meters per minute) is maintained; and $V_2$ is about 550 feet per minute (about 167.64 meters per minute), and $V_3$ is about 560 (about 170.688 meters per minute). The paper web is dried in the pre-dryer 88 to a fiber consistency of from about 70% to about 60% after the pre-dryer; and further dried on the Yankee dryer 91 to from about 96% to about 98%. The resulting paper has a basis weight of from about 14 to about 18 pounds per three-thousand square feet (from about 23 to about 29 grams per square meter), and a dry caliper of from about 20 mils to about 35 mils.

After being creped off the Yankee dryer 91 by the creping blade 93, the paper web 30 passes over a creping foil 700 and continues on to the reel roll 94. The creping foil 700 is located about 3 inches in the machine direction from the creping blade 93. The creping foil 700 has a width of about 234 inches (about 594.36 cm), height of about 10 inches (about 25.4 cm), and a thickness of about 3 inches (about 7.62 cm). The creping foil 700 has a radius of curvature of about 300 inches (about 762 cm). Compressed air is supplied to the upper pipe 714 of the creping foil 700 at a pressure of 8 psig (about 0.544368 atm). Note that gauge pressure differs from the absolute pressure (i.e. actual pressure) as absolute pressure is equal to the gauge pressure plus atmospheric pressure. Air is provided to the lower pipe 716 of the creping foil 700 at a gauge pressure of about 40 inches of water (about 0.098333 atm) with a flow rate of 350 cubic feet per minute (about 9.91 cubic meters per minute).

A dust collection device 99 is located about 100 inches (about 2.54 meters) below the portion of the paper web 30 and about ½ inch (about 1.27 cm) behind the creping blade 93 in the machine direction. The dust collection device 99 draws air from under the paper web 30 using an exhaust fan that draws air at 25000 cubic feet per minute (about 707.921165 cubic meters per minute). The dust collection device 99 has an intake slot of approximately 2.5 inches (about 6.35 cm) in the machine direction and about 220 inches (about 558.8 cm) in the cross machine direction. The intake slot is connected to the fan and a duct which routes the collected air stream through a wet cyclonic separator to remove the dust collected from the air for weighing. The amount of dust collected is weighed after 2 hours of running continuously.

Three runs using the identical conditions were performed and the mean weight is reported.

Dust Collected—8.58 lb/hr

Papermaking Machine without a Creping Foil

A paper web is made in accordance with the prior example except that no creping foil is used in the creping section of the papermaking machine Three runs using the identical conditions were performed and the mean weight is reported.

Dust Collected w/o Creper Foil—4.99 lb/hr

All publications, patent applications, and issued patents mentioned herein are hereby incorporated in their entirety by reference. Citation of any reference is not an admission regarding any determination as to its availability as prior art to the claimed invention.

Herein, "comprising" means the term "comprising" and can include "consisting of" and "consisting essentially of."

The dimensions and values disclosed herein are not to be understood as being strictly limited to the exact numerical dimensions or values recited. Instead, unless otherwise specified, each such dimension or value is intended to mean both the recited dimension or value and a functionally equivalent range surrounding that dimension or value. For example, a dimension disclosed as "40 mm" is intended to mean "about 40 mm".

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A creping section of a papermaking machine comprising a drying roll, creping blade, and creping foil;

the creping foil comprising: a machine direction, cross machine direction, and Z-direction normal to a plane formed by machine direction and cross machine directions, the creping foil further comprising a front face, back face, and bottom side;

wherein the front face comprises one or more top conduits having one or more upper pipes integrally mounted therein; the one or more upper pipes are rotatable about an axis in the cross machine direction and have one or more upper diameter holes; and wherein the bottom side comprises one or more bottom conduits having one or more lower pipes integrally mounted therein; the one or more lower pipes are rotatable about an axis in the cross machine direction and have one or more lower diameter holes.

2. The creping section according to claim 1 wherein the creping foil is located from about 2" to about 10" in the machine direction from the creping blade.

3. The creping section according to claim 2 wherein the creping foil is located from about 3" to about 8" in the machine direction from the creping blade.

4. A creping foil for the creping section of a papermaking machine comprising:

a machine direction, cross machine direction, and Z-direction normal to a plane formed by machine direction and cross machine directions, the creping foil further comprising a front face, back face, and bottom side;

wherein the front face comprises one or more top conduits having one or more upper pipes integrally mounted therein; the one or more upper pipes are rotatable about an axis in the cross machine direction and have one or more upper diameter holes; and wherein the bottom side comprises one or more bottom conduits having one or more lower pipes integrally mounted therein; the one or more lower pipes are rotatable about an axis in the cross machine direction and have one or more lower diameter holes.

5. The creping foil according to claim 4 wherein the one or more upper pipes are rotatable such that the one or more upper diameter holes are directed at an angle of from about −80 degrees to about +80 degrees.

6. The creping foil according to claim 5 wherein the one or more upper pipes are rotatable such that the one or more upper diameter holes are directed an angle of from about −45 degrees to about +45 degrees.

7. The creping foil according to claim 4 wherein the one or more upper pipes protrude from about 1/16" to about 1/2" from the front face of the creping foil.

8. The creping foil according to claim 4 wherein the one or more lower pipes are rotatable such that the one or more lower diameter holes are directed an angle of from about −80 degrees to about +80 degrees.

9. The creping foil according to claim 8 wherein the one or more lower pipes are rotatable such that the one or more lower diameter holes are directed an angle of from about −45 degrees to about +45 degrees.

10. The creping foil according to claim 4 wherein the one or more upper pipes protrude from about 1/32" to about 1/4" from the front face of the creping foil.

11. The creping foil according to claim 4 wherein the creping foil has a thickness of from about 1" to about 10".

12. The creping foil according to claim 11 wherein the creping foil has a thickness of from about 2" to about 3".

13. The creping foil according to claim 4 wherein the creping foil has a width of from about 100" to about 360".

14. The creping foil according to claim 13 wherein the creping foil has a width of from about 140" to about 300".

15. The creping foil according to claim 4 wherein the upper diameter holes have a width of from about 0.005" to about 0.5".

16. The creping foil according to claim 4 wherein the upper diameter holes are spaced from about 1/8" to about 4" apart.

17. The creping foil according to claim 4 wherein the lower diameter holes have a width of from about 0.005" to about 0.5".

18. The creping foil according to claim 4 wherein the upper diameter holes are spaced from about 1/8" to about 4" apart.

19. A creping foil comprising:

a machine direction, cross machine direction, and Z-direction normal to a plane formed by machine direction and cross machine directions, the creping foil further comprising a front face, back face, bottom side, and two or more side faces;

wherein the front face comprises one or more top conduits having one or more upper pipes integrally mounted therein; the one or more upper pipes are rotatable about an axis in the cross machine direction and have one or more upper diameter holes;

wherein the bottom side comprises one or more bottom conduits having one or more lower pipes integrally mounted therein; the one or more lower pipes are rotatable about an axis in the cross machine direction and have one or more lower diameter holes; and wherein one or more side faces comprises one or more creping foil pivots.

20. The creping foil according to claim 19 further comprising an arm having a proximal end and a distal end wherein the one or more creping foil pivots are attached to the proximal end of the one or more arms.

21. The creping foil according to claim 20 wherein the one or more arms comprise one or more arm pivots that are located at the distal end of the one or more arms.

* * * * *